US008091486B1

(12) United States Patent
Broaddrick

(10) Patent No.: US 8,091,486 B1
(45) Date of Patent: Jan. 10, 2012

(54) ADJUSTABLE TRAY

(76) Inventor: Juanita Broaddrick, Van Buren, AR (US)

( * ) Notice: Subject to any disclaimer, the term of this patent is extended or adjusted under 35 U.S.C. 154(b) by 266 days.

(21) Appl. No.: 12/583,411

(22) Filed: Aug. 20, 2009

(51) Int. Cl.
*A47B 23/00* (2006.01)

(52) U.S. Cl. ..... 108/43; 108/25; 248/444

(58) Field of Classification Search ..... 108/43, 108/44, 42, 45, 46, 47, 152, 26, 165, 157.14; 206/562, 564, 557, 565; 229/120.05, 155, 229/904, 120.24; 248/444
See application file for complete search history.

(56) References Cited

U.S. PATENT DOCUMENTS

| | | | | | |
|---|---|---|---|---|---|
| 126,213 | A | * | 4/1872 | Ireland et al. | 108/43 |
| 378,752 | A | | 2/1888 | Ader | |
| 3,034,153 | A | | 5/1962 | Sargent | 5/98 |
| 3,115,639 | A | | 12/1963 | Moszczynski | 2/48 |
| 3,199,467 | A | | 8/1965 | Compton | 108/49 |
| 3,226,006 | A | * | 12/1965 | Dunn | 229/195 |
| 3,318,456 | A | * | 5/1967 | Lipe | 108/44 |
| 3,336,608 | A | * | 8/1967 | Lerner | 5/99.1 |
| 3,492,680 | A | * | 2/1970 | Coolidge | 5/99.1 |
| 3,524,614 | A | | 8/1970 | Sorth | 248/131 |
| 3,799,071 | A | | 3/1974 | Gerlach | 108/46 |
| 4,143,915 | A | | 3/1979 | Kamlay | 297/390 |
| 4,453,764 | A | | 6/1984 | Hennessy | 297/153 |
| 4,770,107 | A | * | 9/1988 | Miller | 108/44 |
| 4,795,028 | A | | 1/1989 | Wittig et al. | 206/217 |
| 4,999,863 | A | * | 3/1991 | Kane | 5/99.1 |
| 5,046,433 | A | | 9/1991 | Kramer et al. | 108/44 |
| 5,090,334 | A | * | 2/1992 | Sutton | 108/43 |
| 5,127,339 | A | | 7/1992 | Hood, Jr. | 108/43 |
| 5,129,520 | A | | 7/1992 | Gaspar | 206/534 |
| 5,176,274 | A | | 1/1993 | Jenkins | 220/17.1 |
| 5,186,350 | A | | 2/1993 | McBride | 220/412 |
| 5,224,637 | A | | 7/1993 | Colombo | 224/159 |
| 5,241,835 | A | | 9/1993 | Ascone | 62/372 |
| 5,366,089 | A | | 11/1994 | Parker | 206/546 |
| 5,443,018 | A | | 8/1995 | Cromwell | 108/44 |
| 5,458,394 | A | | 10/1995 | Nichols et al. | 297/173 |
| 5,473,785 | A | * | 12/1995 | Lager et al. | 5/655 |
| 5,479,866 | A | | 1/1996 | Rae | 108/44 |
| 5,558,026 | A | | 9/1996 | Seibert | 108/44 |
| 5,642,674 | A | | 7/1997 | Joye, Sr. et al. | 108/43 |
| 5,649,654 | A | | 7/1997 | Hayward, Jr. | 224/276 |
| 5,664,671 | A | | 9/1997 | Nedblake, Jr. | 206/217 |
| 5,671,479 | A | | 9/1997 | Dedrick | 2/46 |
| D401,214 | S | | 11/1998 | Benavidez et al. | D12/716 |
| 5,829,627 | A | | 11/1998 | Martindale | 220/666 |
| 5,862,933 | A | | 1/1999 | Neville | 220/17.1 |
| 5,941,436 | A | | 8/1999 | Washington et al. | 224/270 |
| 6,053,402 | A | | 4/2000 | Thomas et al. | 229/120.011 |

(Continued)

*Primary Examiner* — Jose V Chen
(74) *Attorney, Agent, or Firm* — Keisling & Pieper, PLC; Stephen D. Schrantz

(57) ABSTRACT

The adjustable tray provides a central body adapted to receive drinks, food, toys, reading material, or any other item(s) that a user places upon the central body. Retention arms pivotally attached to the central body adjust to a retaining position that extends the retention arms above the central body. The retention arms also adjust to an elevating position that extends the retention arms below the central body to raise the central body. Retention arms also detach from each other to pivot freely to avoid obstructing placement of larger items on the central body. A retention lip also maintains items within the confines of the adjustable tray. Unique webbing of the present invention allows the user to adjust the length of webbing extending from the central body and to secure either the front or the rear of the adjustable tray around the user and/or object (s).

4 Claims, 7 Drawing Sheets

U.S. PATENT DOCUMENTS

| | | | | |
|---|---|---|---|---|
| 6,116,166 | A | 9/2000 | Rotstein | 108/43 |
| 6,170,405 | B1 * | 1/2001 | Weitzman et al. | 108/25 |
| 6,305,656 | B1 | 10/2001 | Wemyss | 248/309.4 |
| 6,659,545 | B1 | 12/2003 | McMillan | 297/153 |
| 6,986,308 | B1 | 1/2006 | King et al. | 108/43 |
| 6,989,168 | B2 | 1/2006 | Fahey | 426/102 |
| 7,025,199 | B1 * | 4/2006 | Lim | 206/217 |
| D550,477 | S * | 9/2007 | Probst | D6/406.5 |
| 2007/0029848 | A1 | 2/2007 | Probst | 297/148 |
| 2007/0227919 | A1 | 10/2007 | True | 206/219 |

* cited by examiner

ADJUSTABLE TRAY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention relates to an adjustable tray for use in the car, at home, or at any other location. The present invention can rest in a user's lap during use or can be placed on a surface including but not limited to tables, countertops, the floor, or any other surface where a user may use a tray.

Small children will often play with or hold various toys, drinks, or other items. Most children experience difficulties in placing these objects on their lap as the items may fall off of the child's lap. Children may then not be able to retrieve such items that fall from their laps. Children may then become agitated that they cannot retrieve the items and may start crying or causing other disturbances that can bother some people or can lead to hazardous situations. Furthermore, such dropped items can cause injuries to passengers in a car during an accident.

The present invention relates to an adjustable tray particularly suited for use when seated, such as in an airplane or automobile. The adjustable tray of the present invention provides a convenient and secure area for a child to play and prevents toys or food from being easily spilled or dropped from the confines of the present invention.

II. Description of the Known Art

Trays have become widely popular for a variety of uses. A growing number of people have increased their usage of trays. The known art discusses several approaches to trays that have been implemented. Patents and patent applications disclosing information relevant to trays are disclosed below. These patents and patent applications are hereby expressly incorporated by reference in their entirety.

U.S. Pat. No. 4,770,107 issued to Miller on Sep. 13, 1998 ("the '107 patent") teaches a portable and collapsible travel tray assembly for mounting in conjunction with a conventional automobile seat positioned to the front of the user of the tray and the seat of the user, particularly a child's car seat.

U.S. Pat. No. 6,659,545 issued to McMillan on Dec. 9, 2003 ("the '545 patent") teaches a tray assembly for use with a child's booster seat in an automobile, the booster seat having a back and a pair of sides, each side having a side top, the tray assembly including a foam tray and an anchoring strap.

U.S. Pat. No. 6,116,166 issued to Rotstein on Sep. 12, 2000 ("the '166 patent") teaches a fully collapsible child's travel tray that fits closely to the child to prevent playthings or food from falling into the child's lap or to the floor of a vehicle in which the child is riding and restrained.

U.S. Pat. No. 5,941,436 issued to Washington on Aug. 24, 1999 ("the '436 patent") relates to a wearable tray assembly particularly designed for those who stock shelves or perform similar tasks.

U.S. Pat. No. 5,127,339 issued to Hood on Jul. 7, 1992 ("the '339 patent") teaches a foldable lap tray that is formed from a unitary blank of semi-rigid sheet material, such as corrugated cardboard.

U.S. Pat. No. 5,443,018 issued to Cromwell on Aug. 22, 1995 ("the '018 patent") teaches a first box and a second box that are connected to a base member.

None of the known art provides the features of the present invention. Therefore, the present invention is needed to provide the user with increased versatility of a tray. The present invention is also needed to provide a user with the ability to retain items within the tray, to increase the workspace of the tray, and to elevate the tray above a support surface. The present invention is also needed to allow a user to store certain items, including but not limited to beverages, within a particular area of the tray without limiting the functionality of a tray. The present invention also provides a releasably attached webbing that increases the number of ways and items to which the present invention may be attached.

SUMMARY OF THE INVENTION

The present invention provides a central body adapted to receive drinks, food, toys, reading material, articles or any other item(s) that a user may place upon the central body. The present invention provides retention arms that are pivotally attached to the central body of the adjustable tray. The retention arms adjust to a retaining position that extends the retention arms above the central body to maintain items within the confines of the tray. The retention arms also adjust to an elevating position that extends the retention arms below the central body to elevate the central body above the surface upon which the present invention rests. In between these two positions, the retention arms can be adjusted such that the retention arms do not extend above the central body thus allowing items larger than the central body to be placed on the tray.

The present invention also provides a retention lip that maintains items within the confines of the central body 102. The retention lip can also be padded to increase the comfort of the user by cushioning the area that contacts the user.

The present invention also utilizes a unique retention compartment. The retention compartment provides storage space for items to be stored within the retention compartment on the central body. The retention compartment limits movements of particular items on the central body. In one embodiment, the retention compartment allows storage of a beverage container on the central body. In one embodiment, the retention compartment is releasably attached to one of the retention arms such that the retention compartment can be removed to increase the usable surface of the central body. In another embodiment, the retention compartment utilizes a magnetic bottom that attaches to a metallic portion of stored approximate the central body.

The present invention also provides unique webbing that allows the user to secure the present invention around the user or around another object. The webbing of the present invention adjusts to fit around different sized objects or users. The webbing of the present invention provides two separate ends that releasably attach to the retention arms. To adjust the length of the webbing extending from the rear of the present invention, the user adjusts the attachment of the webbing on the retention arms to increase or decrease the amount of webbing that extends from the present invention. The two releasably attached ends of the webbing also simplifies the attachment of the present invention around objects and/or users. In one embodiment of the present invention, the webbing releasable attaches such that the user can change the manner in which the present invention attaches. The user may also remove the webbing entirely. The webbing of the present invention allows a user to attach the front or rear of the present invention to the user and/or object as will be discussed below.

It is therefore an object of the present invention to provide an adjustable tray.

It is a further object of the present invention to provide retention arms that pivot to extend above the central body to maintain items within the confines of the central body.

It is a further object of the present invention to provide retention arms that pivot to extend below the central body to raise the central body above a support surface.

It is a further object of the present invention to release the retention arms from each other to allow the retention arms to pivot freely to allow larger items to be placed on the central body.

It is a further object of the present invention to provide webbing that releasably attaches from the present invention to increase the ease with which a user may attach the present invention.

It is a further object of the present invention to provide webbing that may be completely removed from the present invention.

It is a further object of the present invention to provide webbing that may extend from the front of the central body to attach the front of the central body to an object and/or user.

It is a further object of the present invention to provide webbing that may extend from the rear of the central body to attach the rear of the central body to an object and/or user.

It is a further object of the present invention to provide a retention lip that maintains items within the confines of central body.

It is a further object of the present invention to provide padding on the retention lip to increase the comfort of the user wherein such padding provides the user to rest his arms and/or wrists and may contact the user's midsection.

It is a further object of the present invention to provide padding on the bottom of the present invention to increase the users comfort.

It is a further object of the present invention to provide a tray which can be used to hold various objects while riding.

It is a further object of the present invention to provide a tray which can be used by a small child which minimizes any risk of injury due to the tray itself.

It is a further object of the present invention to maintain the placement of the adjustable tray by a webbing that may be anchored around a user or an object.

It is a further object of the present invention to provide a releasably attached webbing that may be removed from the present invention.

It is a further object of this invention to provide a tray which makes it easier for a child to hold onto objects with which he/she is playing, and thereby avoid having to retrieve the objects from the floor or other areas. Accordingly, this tray provides a large surface upon which objects may be placed.

It is a further object of this invention to provide a tray which is inexpensive and easy to maintain.

It is a further object of the present invention to provide such a device wherein a bottom member and walls thereof are encapsulated in a waterproof material.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
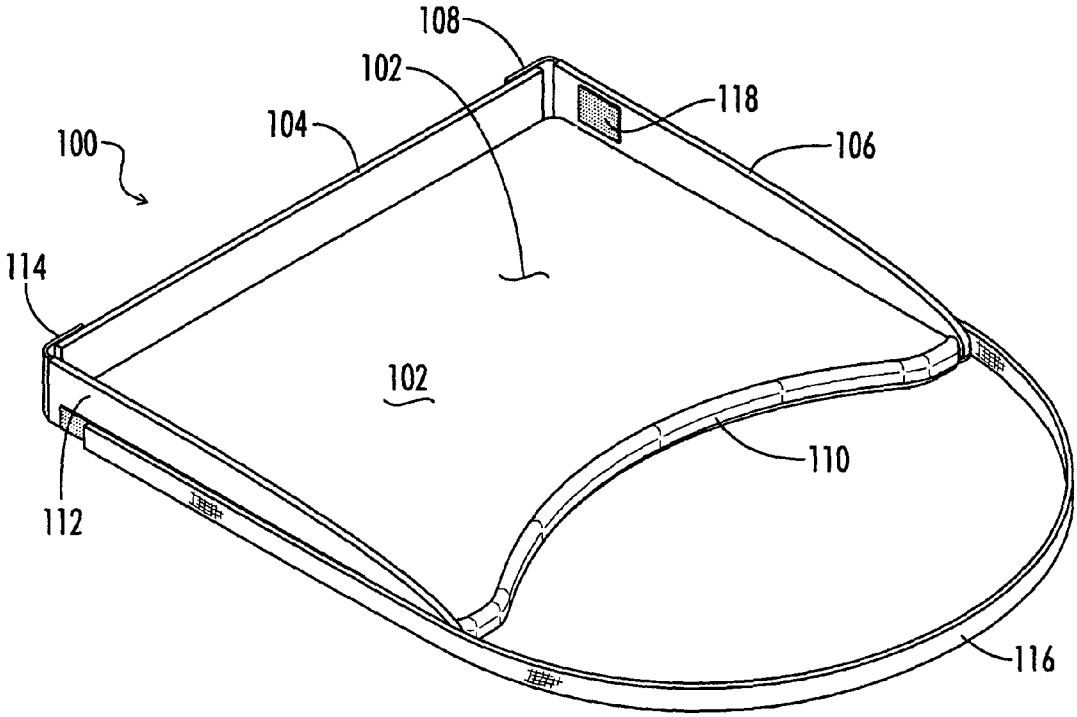
FIG. 1 is a perspective view of one embodiment of the present invention.

Referring to FIGS. 1-5, the tray of one embodiment of the present invention is generally shown as 100. FIG. 1 shows the central body 102 adapted to receive drinks, food, toys, reading material, articles or any other item(s) that a user may place upon the central body 102. Retention arms 104, 106, 112 pivotally attach to the front of central body 102, front retention arm 104, the right side of central body 102, side retention arm 106, and the left side of central body 102, side retention arm 112 ce. Retention arms 104, 106, 112 pivot in relation to the central body 102 such that the retention arms 104, 106, 112 extend above the central body 102 when in the retaining position as shown in FIGS. 1, 2, 4 and 5 to maintain items within the confines of the tray 100. The retention arms 104, 106, 112 also adjust to an elevating position, shown in FIGS.

12 and 13, that extends the retention arms 104, 106, 112 below the central body 102 to elevate the central body 102 above the surface upon which the present invention rests. In between these two positions, the retention arms 104, 106, 112 can be adjusted such that the retention arms 104, 106, 112 do not extend above the central body 102 thus allowing items larger than the central body 102 to be placed on the tray 100 as seen in FIGS. 3, 6, 7, and 8.

The present invention also provides a retention lip 102 that maintains items within the confines of the central body 102. The retention lip 110 attaches to the rear of central body 102. As shown in FIG. 1, retention lip 110 and the rear portion of central body 102 provide a curvature for a more secure fit against a user. Other embodiments of the present invention do not provide the curvature of the rear portion of central body 102. Retention lip 110 can also be padded to increase the comfort of the user by cushioning the area that contacts the user. In another embodiment of the present invention, retention lip 110 may be replaced with a retention arm similar to front retention arm 104.

Figure 17:
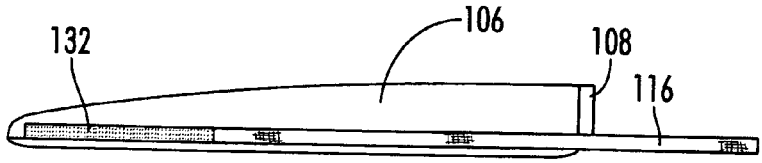
FIG. 17 is a right side view of one embodiment of the present invention.

Continuing to refer to FIG. 1, webbing 116 provides two ends that releasably attach to side retention arms 106, 112. The releasable attachment of webbing 116 allows adjustment of webbing 116 to increase or decrease the amount of webbing 116 extending from central body 102. The webbing 116 may extend from the rear of the central body 102 as shown in FIG. 1 or from the front of central body 102 as shown in FIG. 17.

Figure 2:
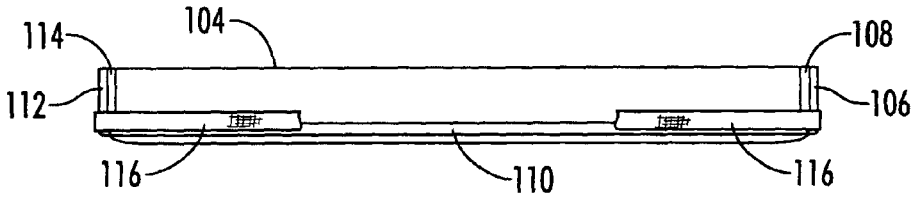
FIG. 2 is a rear view thereof.
Figure 3:
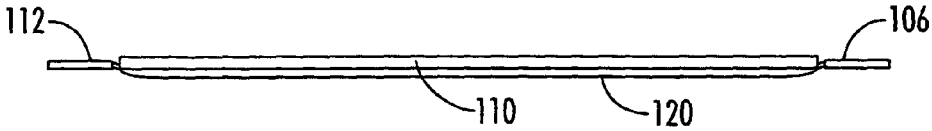
FIG. 3 is another rear view thereof.

As shown in FIG. 2, retention lip 110, side retention arms, 106, 112 and front retention arm 104 extend above central body 102 to maintain items stores within central body 102. The pivotal attachment of side retention arms 106, 112 and front retention arm 104 allows the retention arms 104, 106, 112 to pivot downward as shown in FIG. 3. Retention arms 104, 106, 112 pivoted downward do not extend above central body 102 such that retention arms 104 will not obstruct larger items that may be placed on the central body 102. A portion of webbing 116 that extends from the rear of central body has been removed from FIG. 2 to show the central body 102. FIG. 3 also shows padding 120 that may be installed or attached on the bottom of the central body to increase the comfort of a user who has placed the present invention in the user's lap.

Figure 4:
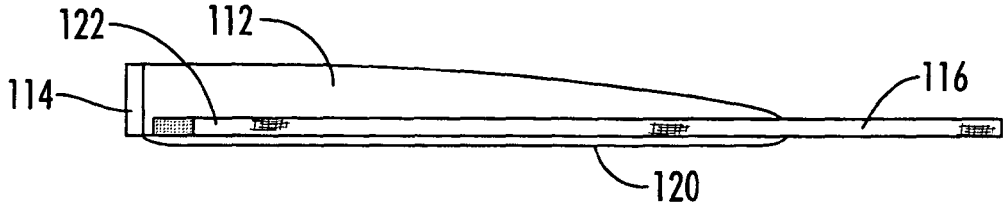
FIG. 4 is a left side view thereof, the right side view being a mirror image thereof.

FIG. 4 shows a left side view of the present invention, the right side being a mirror image. Webbing attachment 122 of webbing 120 releasably attaches to side retention arm 112. Webbing 120 has a second webbing attachment 134 that likewise attaches to side retention arm 106. The adjustment of webbing 120 to side retention arms 106, 112 will be discussed below.

Figure 5:
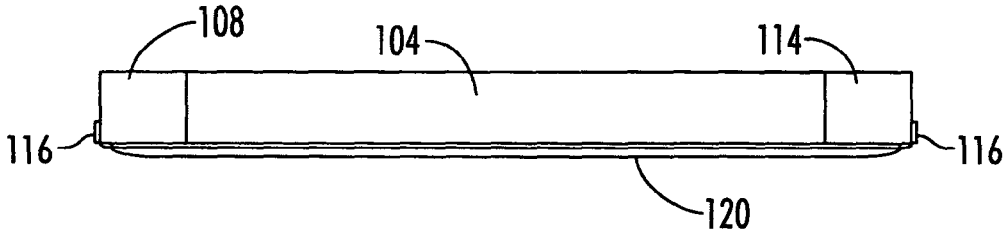
FIG. 5 is a front view thereof.

FIG. 5 shows a front view of the present invention. Front retention arm 104, pivotally attached to the front of central body 102, adjusts to the retaining position such that front retention arm 104 extends above, central body 102. Retention fingers 108, 114 of side retention arms 106, 112 respectively releasably attach to front retention arm 104. The attachment of retention fingers 108, 114 to front retention arm 104 shown in FIG. 5 secures the retention arms 104, 106, 112 in the retaining position. In another embodiment, retention fingers may pivotally attach to front retention arm. In such an embodiment, retention fingers of the front retention arm extend beyond the sides of central body to contact side retention arms. The retention fingers of the front retention arm pivotally attach approximately adjacent each side of central body.

Figure 6:
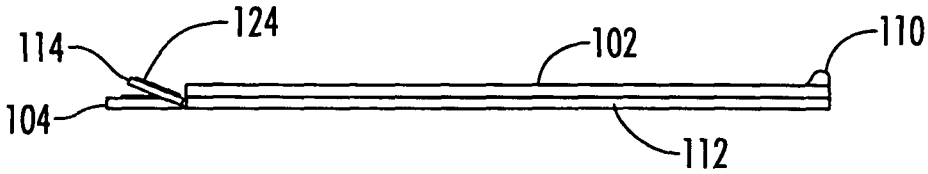
FIG. 6 is another left side view showing a retention finger slightly elevated thereof.
Figure 7:
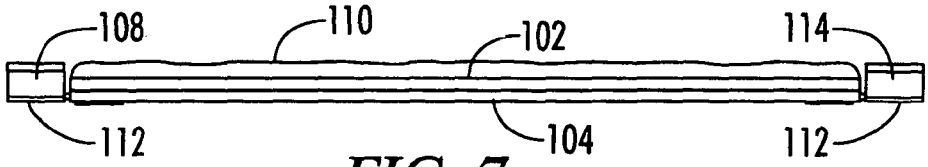
FIG. 7 is another front view showing two retention fingers slightly elevated thereof.
Figure 8:
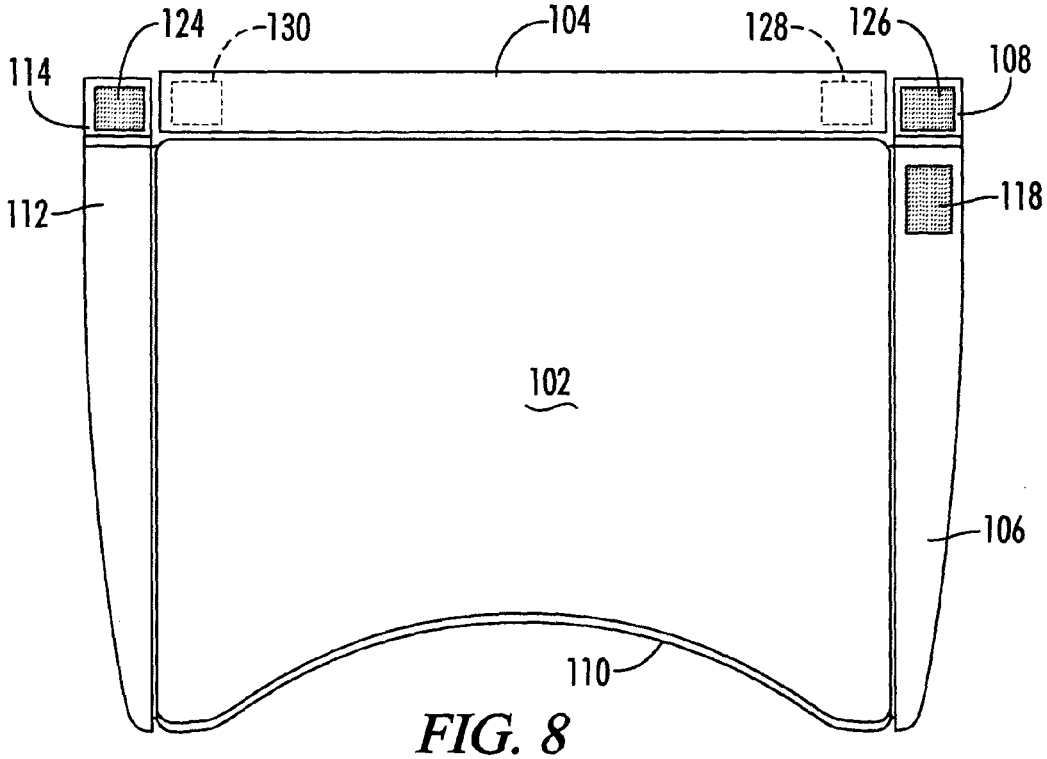
FIG. 8 is a top plan view thereof.

The attachment of retention fingers 108, 114 to front retention arm 104 is shown in FIGS. 5-11. FIG. 6 shows a left side view of the present invention with the retention finger 114 slightly pivoted. Retention arms 106, 112, pivotally attached to the right and left of central body 102, pivot in relation to central body 102. Retention fingers 108, 114 pivotally attach to side retention arms 106, 112 approximately adjacent the front of central body 102. Retention fingers 108, 114 pivot to contact front retention arm 104. As shown in FIGS. 6 and 8, retention fingers 108, 114 extend beyond the front of the central body 102 such that retention fingers 108, 114 pivot to contact front retention arm 104 to secure retention fingers 104, 108, 114 in the retaining position. Retention fingers 108, 114 provide finger attachments 124, 126 to contact the outer side of front retention arm 104 in the retaining position as shown in FIG. 5.

FIGS. 7 and 8 show retention arms 104, 106, 112 detached from the other retention arms 104, 106, 112 such that retention arms 104, 106, 112 pivot freely. Retention arms 104, 106, 112 detached from each other pivot freely such that retention arms 104, 106, 112 do not obstruct the placement of larger items on central body 102.

Figure 9:
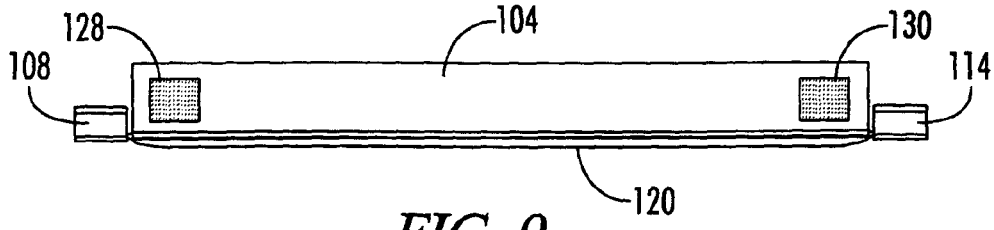
FIG. 9 is another front view thereof.
Figure 10:
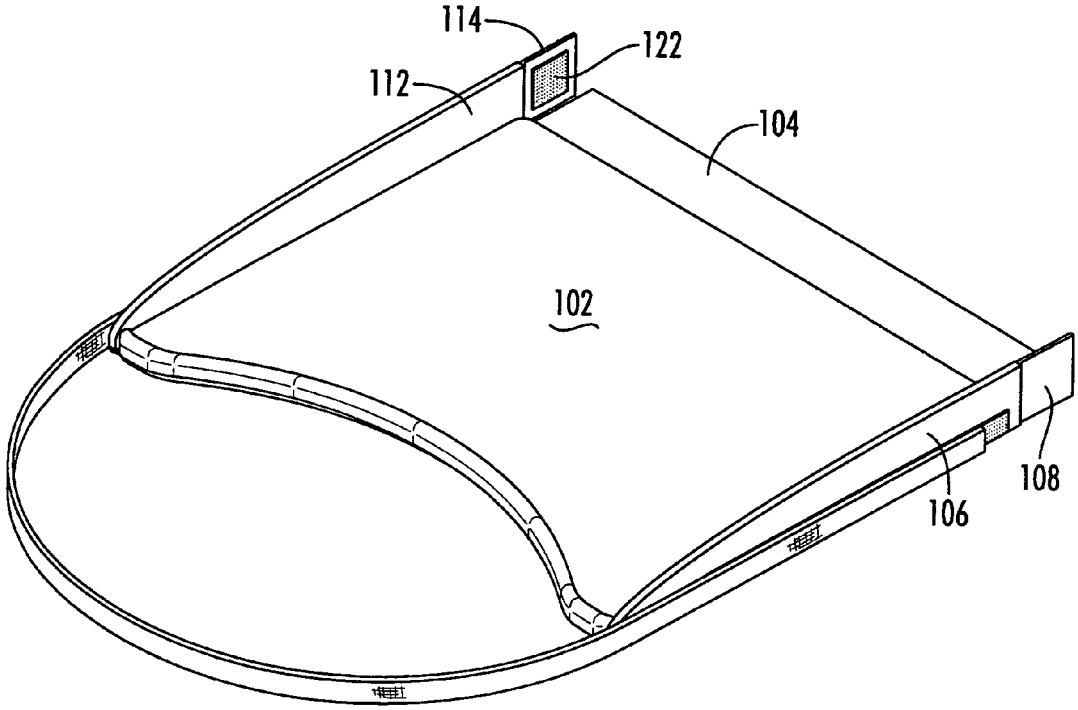
FIG. 10 is a perspective view of a portion of one embodiment of the present invention.
Figure 11:
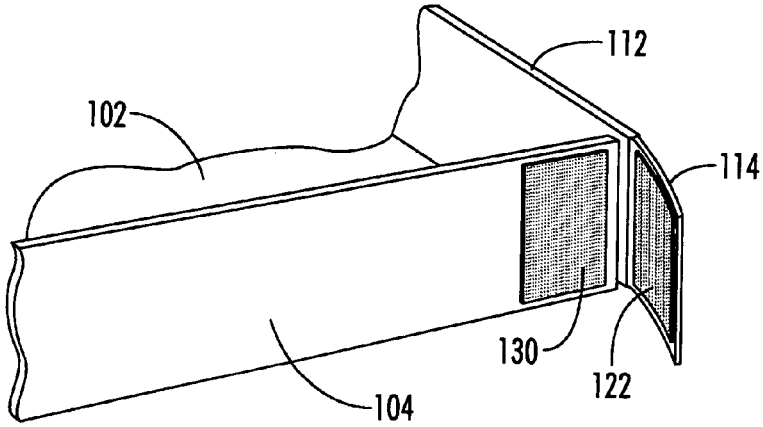
FIG. 11 is a perspective view of a portion of one embodiment of the present invention.

FIGS. 9-11 show the process of attaching the retention arms 104, 106, 112 to each other to secure the retention arms 104, 106, 112 in the retaining position. In FIG. 9, front retention arm 104 is adjusted to the retaining position to expose arm attachments 128, 130. In one embodiment, arm attachments 128, 130 of front retention arm 104 are located on the outer side of the front retention arm 104 in the retaining position. In another embodiment, the arm attachments 128, 130 may be placed on the inner side of the front retention arm 104 in the retaining position. Exposure of the arm attachments 128, 130 provide a contact area for the attachment of finger attachments 124, 126 of retention fingers 114, 108. After front retention arm 104 and side retention arms 106, 112 adjust to the retaining position shown in FIG. 11, the user pivots retention fingers 108, 114 toward front retention arm 104. Continuing to refer to FIG. 11, in one embodiment of the present invention, the retention fingers 108, 114 pivot in relation to the retention arms 106, 112 approximately adjacent the front end of the central body 102. Retention fingers 108, 114 of retention arms 106, 112 pivot toward front retention arm 104 such that finger attachments 124, 126 contact arm attachments 128, 130 to releasably attach retention arms 104, 106, 112 to secure retention arms 104, 106, 112 in the retaining position.

Figure 12:
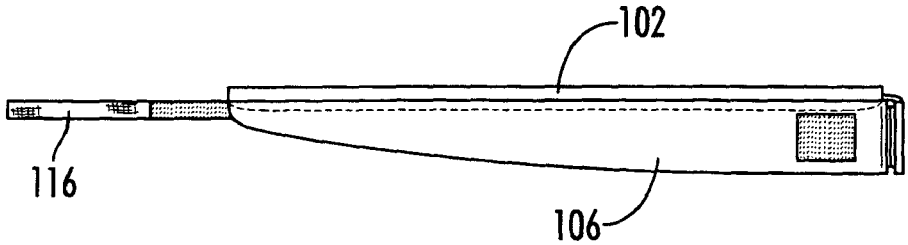
FIG. 12 is a right side view of one embodiment of the present invention.
Figure 13:
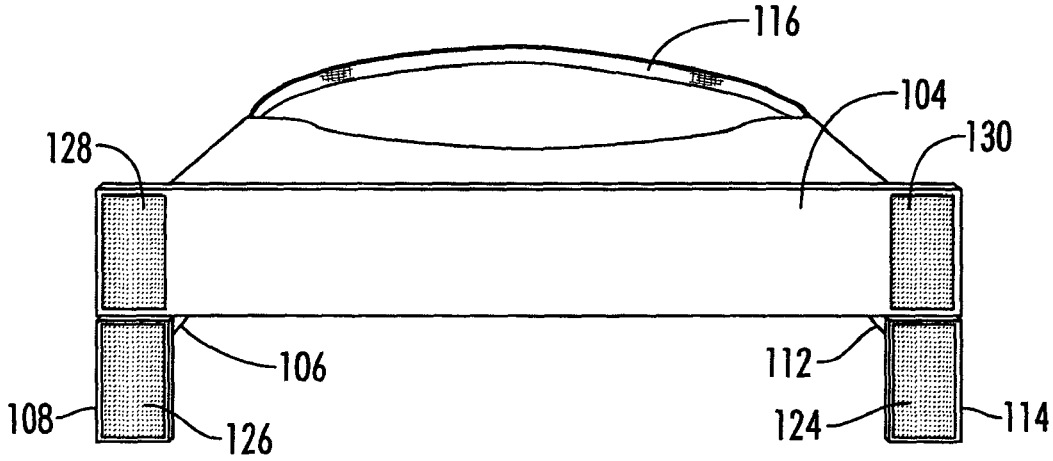
FIG. 13 is a front perspective view showing a retention arm elevated thereof.

FIGS. 12-13 show the retention arms 104, 106, 112 adjusting to the elevating position. The retention fingers 104, 106, 112 in the elevating position raise central body 102 above the supporting surface whether it be a user's lap, table, floor, or other surface. To adjust the present invention into an elevated position, retaining arms 104, 106, 112 pivot down to the elevating position. Retaining fingers 108, 114 pivot inward to expose finger attachments 124, 126. Front retention arm 104 pivots downward to contact exposed finger attachments 124, 126 of retention fingers 108, 114 with arm attachments 128, 130 of front retention arm 104 to releasably attach retention arms 104, 106, 112 to secure retention arms 104, 106, 112 in the elevating position.

Figure 14:
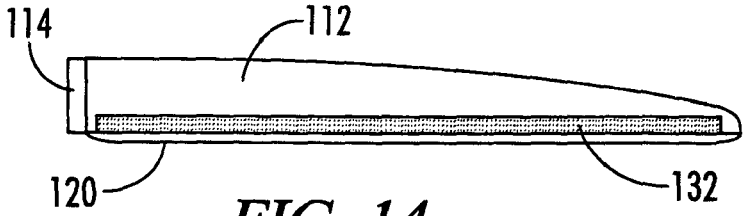
FIG. 14 is a left side view thereof.
Figure 15:
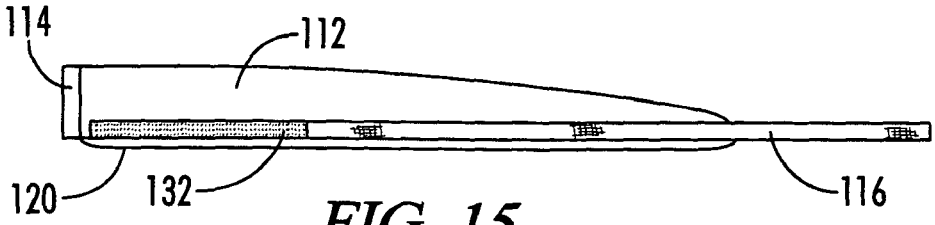
FIG. 15 is a left side view thereof.
Figure 16:
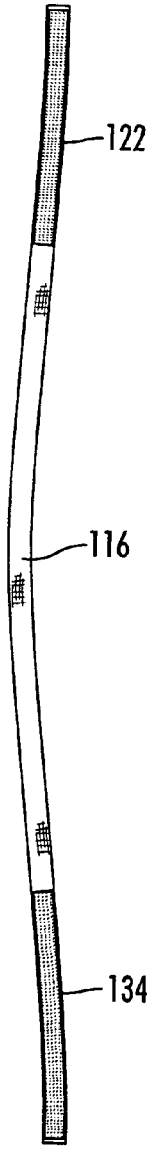
FIG. 16 is a top view of a webbing of the present invention.

FIGS. 14-16 show the releasable attachment of webbing 116 and the adjustment of webbing 116. The releasable attachment of webbing 116 allows a user to secure the present invention around the user or around another object. The length of webbing 116 extending from central body 102 may be adjusted to fit around different sized objects or to vary how securely the present invention attaches to a particular object. As shown in FIG. 14, the webbing 116 may be removed from the present invention. To attach webbing 116 to the present invention, the user determines the length of webbing 116 to extend from central body 102. The user then appropriately attaches webbing attachment 122, 134 of webbing 116, shown in FIG. 16, to webbing anchors 132 of retention arms 106, 112. As shown in FIGS. 4 and 15, webbing attachments 122, 134 attach at any point along webbing anchors 132 of side retention arms 106, 112. FIG. 15 shows that webbing 116 may attached such that more of webbing anchor 132 is exposed. Such attachment increases the length of webbing 116 extending from central body 102. As webbing 116 is attached further along webbing anchor 132 to expose more of webbing anchor 132, the length of webbing 116 extending from central body 102 increases.

The releasable attachment of webbing 116 to central body 102 allows central body 102 to be secured from the front or from the rear. FIG. 15 shows webbing 116 extending outwards from retention lip 110 to secure central body 102 from the rear. FIG. 17, on the other hand, shows webbing 116 extending outwards from front retention arm 104 to secure central body 102 from the front.

Figure 18:
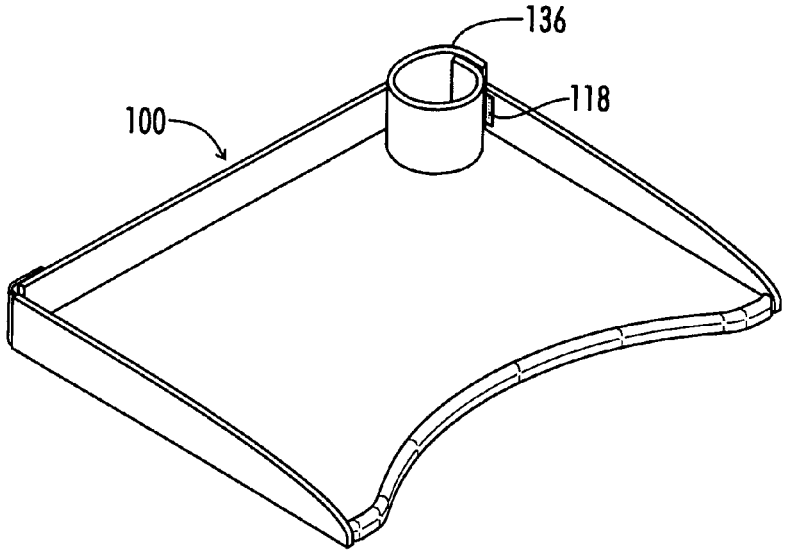
FIG. 18 is a perspective view of one embodiment of the present invention.
Figure 19:
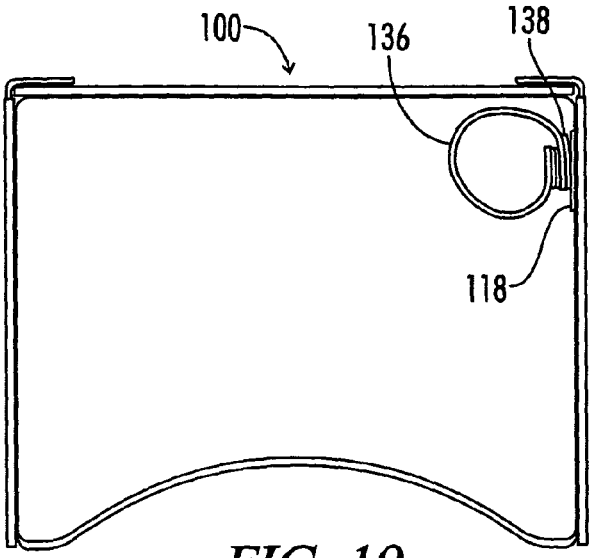
FIG. 19 is a top view thereof.

The present invention also utilizes a unique retention compartment 136 as shown in FIGS. 18-19. The retention compartment 136 provides storage space for items to be stored within the retention compartment 136 on the central body 102. The retention compartment 136 limits movements of items stored within retention compartment 136 on the central body 102. In one embodiment, the retention compartment 136 allows storage of a beverage container on the central body 102. In one embodiment, the retention compartment 136 is releasably attached to one of the retention arms such as retention arm 104, 106, 112 such that the retention compartment can be removed to increase the usable surface of the central body 102. In one embodiment, arm attachment 138 of retention compartment 136 is releasably attached at compartment anchor 118 of a retention arm 104, 106, 112 to prevent compartment anchor 118 from interfering with items placed on central body 102. In yet another embodiment, compartment anchor may be installed directly on central body 102. In yet another embodiment, the retention compartment utilizes a magnetic bottom that attaches to a metallic portion stored approximate the central body 102.

Figure 20:
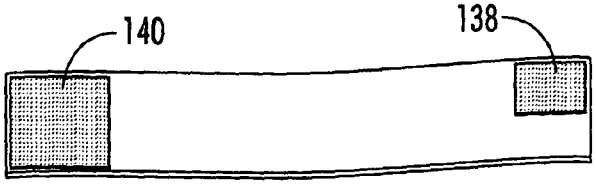
FIG. 20 is a front view of a storage compartment of the present invention.
Figure 21:
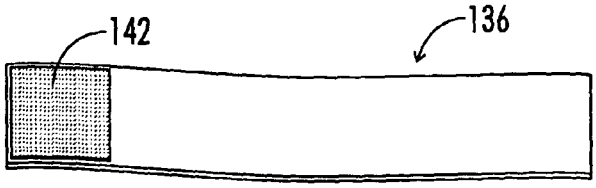
FIG. 21 is a rear view thereof.
Figure 22:
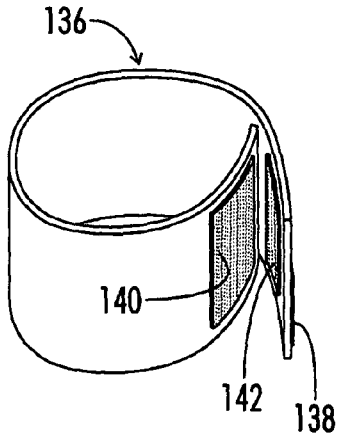
FIG. 22 is a perspective view thereof.

FIGS. 20-22 show retention compartment 136 in greater detail. Compartment attachments 140, 142 releasably attach to each other to create an enclosure formed by retention compartment 136. The releasable attachment of compartment attachments 140, 142 allow retention compartment 136 to vary in size to allow difference sized items to be stored within retention compartment 136. Because retention compartment 136 may hold a beverage, retention compartment 136 may be insulated to maintain the temperature of the beverage. In other embodiments of the present invention, retention compartment may be a known insulated beverage container with an arm attachment or magnetic bottom for attachment to the present invention.

The invention has been described as having releasable attachments. The releasable attachments may include Velcro, hook and pile fasteners, magnetic attachments, buttons, zippers, or other known fasteners that may be used for releasably attachment. The present invention may utilize any such releasable attachment for the releasable attachment of retention arms 104, 106, 112; retention fingers 108, 110; retention compartment 136; and webbing 116.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for receiving articles comprising:

a central body;

a front retention arm pivotably attached to the front of said central body wherein said front retention arm pivots to adjust to a retaining position wherein the front retention arm in the retaining position extends above said central body;

a first side retention arm pivotably attached to a first side of the central body, wherein said side retention arm pivots to adjust to a retaining position wherein the first side retention arm in the retaining position extends above said central body, said first side retention arm in said retaining position adapted to releasably attach with said front retention arm in said retaining position, said attachment of said first side retention arm with said front retention arm in said retaining position maintains said front retention arm and said first side retention arm in said retaining position;

a second side retention arm pivotably attached to a second side of the central body, wherein said second side retention arm pivots to adjust to a retaining position wherein the second side retention arm in the retaining position extends above said central body, said second side retention arm in said retaining position adapted to releasably attach with said front retention arm in said retaining position, said attachment of said second side retention arm with said front retention arm in said retaining position maintains said front retention arm and said second side retention arm in said retaining position;

said front retention arm pivots to adjust to an elevating position wherein the front retention arm in the elevating position extends below said central body;

said first side retention arm pivots to adjust to an elevating position wherein the first side retention arm in the elevating position extends below said central body, said first side retention arm in said elevating position adapted to releasably attach with said front retention arm in said elevating position, said attachment of said first side retention arm with said front retention arm in said elevating position maintains said front retention arm and said first side retention arm in said elevating position; and said second side retention arm pivots to adjust to an elevating position wherein the second side retention arm in the elevating position extends below said central body, said second side retention arm in said elevating position adapted to releasably attach with said front retention arm in said elevating position, said attachment of said second side retention arm with said front retention arm in said elevating position maintains said front retention arm and said second side retention arm in said elevating position.

2. The apparatus of claim 1 wherein the height of said first side retention arm at the rear of the central body is less that the height of said first side retention arm at the front of the central body;

the height of said second side retention arm at the rear of the central body is less that the height of said second side retention arm at the front of the central body.

3. An apparatus for receiving articles comprising:

a central body;

a front retention arm pivotably attached to the front of said central body wherein said front retention arm pivots to adjust to a retaining position wherein the front retention arm in the retaining position extends above said central body;

a first side retention arm pivotably attached to a first side of the central body, wherein said first side retention arm pivots to adjust to a retaining position wherein the first side retention arm in the retaining position extends above said central body, said first side retention arm in said retaining position adapted to releasably attach with said front retention arm in said retaining position, said attachment of said first side retention arm with said front retention arm in said retaining position maintains said front retention arm and said first side retention arm in said retaining position;

a second side retention arm pivotably attached to a second side of the central body, wherein said second side retention arm pivots to adjust to a retaining position wherein the second side retention arm in the retaining position extends above said central body, said second side retention arm in said retaining position adapted to releasably attach with said front retention arm in said retaining position, said attachment of said second side retention arm with said front retention arm in said retaining position maintains said front retention arm and said second side retention arm in said retaining position;

said front retention arm pivots to adjust to an elevating position wherein the front retention arm in the elevating position extends below said central body;

said first side retention arm pivots to adjust to an elevating position wherein the first side retention arm in the elevating position extends below said central body, said first side retention arm in said elevating position adapted to releasably attach with said front retention arm in said elevating position, said attachment of said first side retention arm with said front retention arm in said elevating position maintains said front retention arm and said first side retention arm in said elevating position; and said second side retention arm pivots to adjust to an elevating position wherein the second side retention arm in the elevating position extends below said central body, said second side retention arm in said elevating position adapted to releasably attach with said front retention arm in said elevating position, said attachment of said second side retention arm with said front retention arm in said elevating position maintains said front retention arm and said second side retention arm in said elevating position.

4. A method of adjusting a tray comprising:

pivoting a front retention arm pivotably attached to the front of a central body to a retaining position wherein the front retention arm in the retaining position extends above said central body;

pivoting a first side retention arm pivotably attached to a first side of the central body to a retaining position wherein the first side retention arm in the retaining position extends above said central body;

pivoting a second side retention arm pivotably attached to a second side of the central body to a retaining position wherein the second side retention arm in the retaining position extends above said central body;

releasably attaching said front retention arm in said retaining position with said first side retention arm to secure said first side retention arm and said front retention arm in said retaining position;

releasably attaching said front retention arm in said retaining position with said second side retention arm to secure said second side retention arm and said front retention arm in said retaining position;

pivoting a front retention arm pivotably attached to the front of a central body to an elevating position wherein the front retention arm in the elevating position extends below said central body;

pivoting a first side retention arm pivotably attached to a first side of the central body to an elevating position wherein the first side retention arm in the elevating position extends below said central body;

pivoting a second side retention arm pivotably attached to a second side of the central body to an elevating position wherein the second side retention arm in the elevating position extends below said central body;

releasably attaching said front retention arm in said elevating position with said first side retention arm to secure said first side retention arm and said front retention arm in said elevating position; and releasably attaching said front retention arm in said elevating position with said second side retention arm to secure said second side retention arm and said front retention arm in said elevating position.

* * * * *